US005526785A

United States Patent [19]

Masters

[11] Patent Number: 5,526,785

[45] Date of Patent: Jun. 18, 1996

[54] ELECTRONIC IGNITION SYSTEM

[75] Inventor: Stephen C. Masters, El Paso, Tex.

[73] Assignee: Autotronic Controls Corporation, El Paso, Tex.

[21] Appl. No.: 156,569

[22] Filed: Nov. 22, 1993

[51] Int. Cl.[6] ..... F02P 11/02

[52] U.S. Cl. ..... 123/335; 123/632; 123/198 DC

[58] Field of Search ..... 123/335, 334, 123/632, 146.5 D, 198 DC, 618

[56] References Cited

U.S. PATENT DOCUMENTS

| | | | |
|---|---|---|---|
| 3,762,383 | 10/1973 | Richards et al. | 123/335 |
| 4,153,850 | 5/1979 | Boyer | 123/618 |
| 4,368,717 | 1/1983 | Roberts et al. | 123/632 |
| 4,459,951 | 7/1984 | Tobinaga et al. | 123/335 |
| 4,566,425 | 1/1986 | Nitou et al. | 123/600 |
| 4,976,234 | 12/1990 | Okuda | 123/198 DC |
| 5,085,191 | 2/1992 | Okuda | 123/414 |
| 5,138,995 | 8/1992 | Erhard | 123/335 |

*Primary Examiner*—Andrew M. Dolinar
*Attorney, Agent, or Firm*—Fitch, Even, Tabin & Flannery

[57] ABSTRACT

An electronic ignition system replacing corresponding stock circuitry but utilizing the stock magneto and ignition coil provided with the engine of a sport vehicle, such as a jet ski or snowmobile, to provide improved performance. A timing circuit is provided as part of the ignition circuitry to enable a trigger pulse of a predetermined duration to be delivered to the ignition coil and further, to inhibit subsequent trigger pulses limiting the engine speed below a determined rpm limit. The timing circuitry uses an over-temperature switch connecting a capacitance to lengthen the inhibit time period reducing the maximum rpm limit. A holeshot switch connected across the over-temperature switch lowers the rpm limit while the throttle is held in the full speed position. Compensated pickup circuitry, automatic battery connect/disconnect, low impedance kill switch circuitry and an impedance protected tachometer output is provided to enhance the performance and features of the ignition systems of sport vehicles.

15 Claims, 3 Drawing Sheets

ELECTRONIC IGNITION SYSTEM

BACKGROUND OF THE INVENTION

This invention relates to spark generation and timing apparatus for internal combustion engines and particularly to such apparatus for use with engines having existing magneto and ignition coil mounts.

Commercial small engines for sport vehicles such as jet skis and snowmobiles, are produced today having features and performance suited to the average user. Many users, however, desire to improve the performance of their vehicles in an inexpensive and unobtrusive manner. Such improvements include a more energetic spark (hotter spark), longer spark duration, automatic battery connect/disconnect, greater noise immunity at the magnetic-pickup, adjustable maximum rpm limits, automatic rpm limits when the engine overheats, tachometer output and a kill switch for particularized operating environments among other things.

Typically for reasons of manufacturing costs, stock ignition systems deliver electrical charge to engine spark plugs via an ignition coil at energy levels well below component tolerances. Such stock ignition systems also do not usually provide precise control over the resulting spark duration. As a result, the price paid for minimizing manufacturing costs is suboptimal ignition energy and duration which in turn compromises the performance of the internal combustion engine. Although stock ignition systems meet the performance needs of the average user, the need exists for increasing ignition energy to optimal levels and particularly for more precise control over spark duration.

Additionally, it would be desirable to provide adjustable limits on maximum engine speed to keep the engine running within a safe range. Further, when engine operating temperature is detected to be higher than desired, it would be desirable to automatically limit the maximum over-temperature engine speed at a lower level.

A problem that exists in receiving ignition triggering signals from a magnetic-pickup for detecting flywheel tabs is a difficulty in accurately ascertaining the zero crossing of the pickup input voltage. This problem is aggravated for widely varying engine speeds. At slow speeds, the pickup voltage may be only one or two volts triggering at about a 0.5 volt threshold. At fast speeds, the resulting pickup voltage may be well over 10 volts. If the trigger threshold remains at about 0.5 volt, it is likely that the engine will misfire on noise signals at high engine speeds. Accordingly, there exists a need for varying the trigger threshold according to engine speed.

It would be further desirable to provide a kill switch for safety in operating environments which, by their nature, present significant switch and wiring leakages making such kill switches impractical due to the likelihood that unintended switching will occur merely due to the operating environment.

It would be still further desirable to provide a tachometer output for measuring the engine rpm of vehicles whose stock ignition system does not provide tachometer capabilities.

The present invention meets the need for performance improvements and additional features by providing an improved electronic ignition system which conveniently utilizes the existing ignition circuitry of vehicles such as the ignition magneto and coil systems.

SUMMARY OF THE INVENTION

An electronic ignition system in accordance with the present invention includes detection circuitry for receiving a signal input from a magnetic-pickup and circuitry for converting a voltage output of a magneto to a DC voltage trigger pulse, which is then applied to an ignition coil. A timer in a timing circuit is started a predetermined period of time after the voltage output of the pickup is detected and the magneto output is applied to the ignition coil, such that the output of the timer terminates the application of the magneto DC voltage trigger pulse to the ignition coil after a predetermined duration, and further, inhibits the application of subsequent trigger pulses for a period of time defined by the timer in the circuit.

The maximum engine speed as determined by the timing circuit is lowered when an over-temperature switch closes due to engine water being too hot. A capacitance is added in the timing circuit which effectively lengthens the time period during which trigger pulses are inhibited. A switch across the over-temperature switch allows the over-temperature circuitry to be utilized for a holeshot to control engine speed during racing starts.

The detection circuitry also includes threshold circuitry for establishing detection thresholds compensated according to the engine's rpm for the detection of timing pulses from the magnetic-pickup. While the timing circuitry inhibits the application of subsequent trigger pulses, a capacitor is charged and subsequently begins to discharge through a resistor, the capacitor's voltage is then summed with a voltage produced by the pickup to provide compensation therefor by way of a threshold varying with engine speed.

Further circuitry for automatic battery connection and disconnection to the ignition circuitry eliminates the need for an ignition on/off switch and prevents battery drain when the engine is not running. A capacitor is charged via the magneto generated voltage when the engine is spinning thus biasing a switching device to its on state to connect the battery to the ignition circuitry. When the engine stops rotating the battery is not immediately disconnected from the circuitry, however, because the capacitor must be discharged below a minimum required bias level to turn off the switching device.

A kill switch is connected to the timing circuit at a point in the circuitry where the electrical path to ground when the kill switch is closed requires a very low impedance. This prevents effective closure in environments where switch and wiring leakage may be significant, such as salt water environments in the case of a jet ski where such leakage may provide a relatively low resistance path across a kill switch, which is undesirable for obvious reasons.

The electronic ignition system described herein provides additional features which are not provided by stock ignition circuits. One such improvement is the provision of a tachometer output providing an impedance protected output for driving tachometers for engine speed indication. Also provided is the generation of a spark having a longer duration and delivering significantly more energy than that provided by a stock ignition. Other features and advantages of the electronic ignition system will be apparent from the Drawings and Detailed Description.

DETAILED DESCRIPTION OF THE PREFERRED EMBODIMENT

Figure 1:
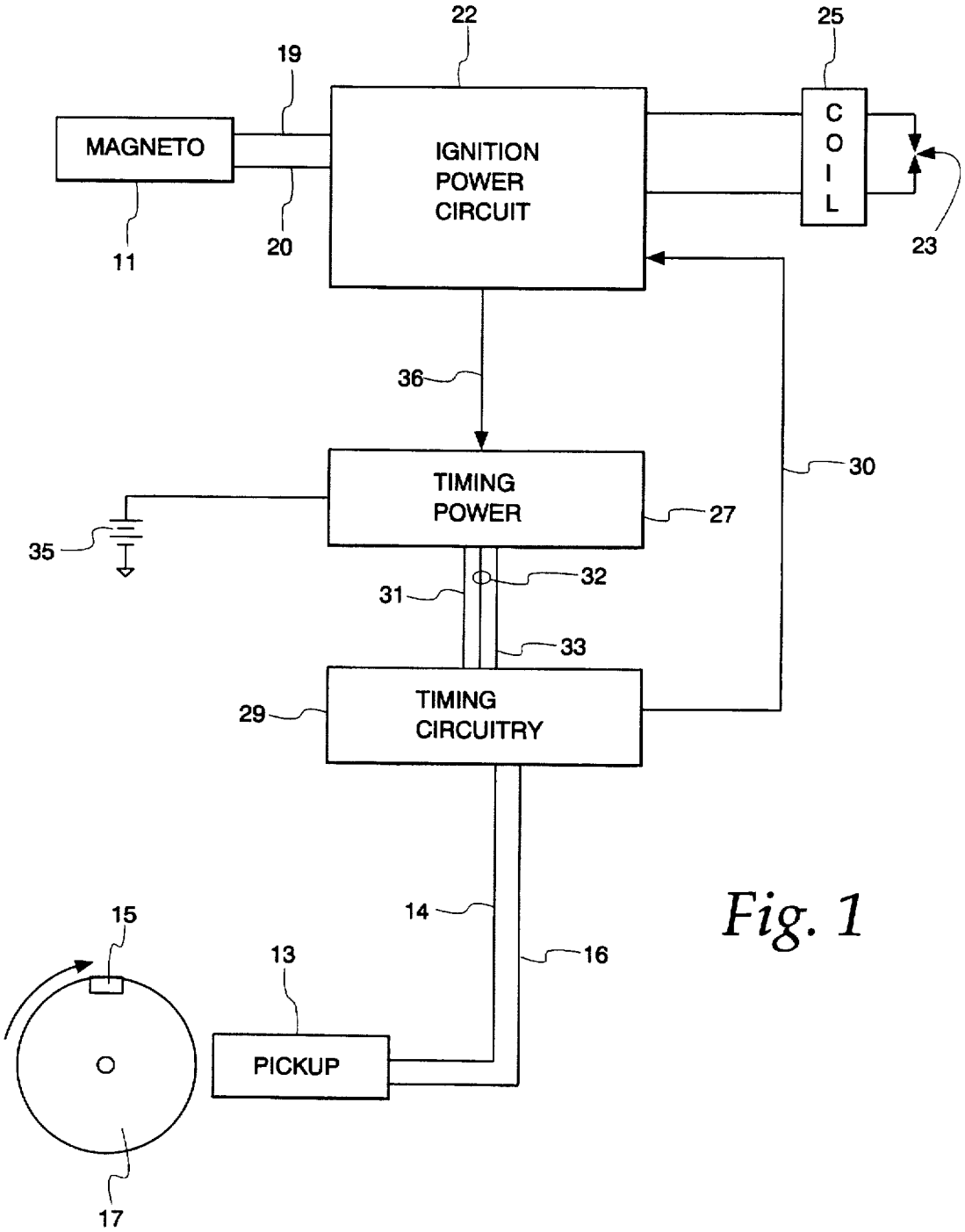
FIG. 1 is a block diagram of an electronic ignition system in accordance with the present invention.

FIG. 1 represents an embodiment of the present invention which is to be used with a Kawasaki 750 Jet Ski although one skilled in the art will appreciate that the invention is suitable for many other systems. FIG. 1 shows a magneto 11 and a magnetic-pickup 13 which are already present in the above-mentioned jet ski. Pickup 13 operates in a well-known manner to detect a particular position 15 on a rotating flywheel 17. A signal is generated by pickup 13 when the position 15 passes and is connected to a timing circuit 19, via conductors 14 and 16. The signal produced by pickup 13 comprises a short pulse having positive voltage when position 15 approaches pickup 13 and a stop transition in a negative direction when position 15 passes the pickup.

Magneto 11 generates, on conductors 19 and 20, an AC signal of sufficient power to produce ignition spark. The signal on conductors 19 and 20 is connected to an ignition power circuit 22 which converts the signal to a high energy spark producing voltage for application to a spark gap 23 via an ignition coil 25.

The arrangement of FIG. 1 also includes a timing circuit 29 which receives the signals from pickup 13 on conductors 14 and 16 and generates a trigger signal on a conductor 30 for control of ignition timing. The timing circuit 29 is powered by a timing power circuit 27 which connects 2 V, 5 V and 12 V power to timing circuit 29 via respective conductors 31, 32 and 33. The voltages for the timing circuit 29 are derived from a 12 V battery 35 of the jet ski system. To avoid drain on the battery 35 during periods of non-use, the voltages on conductors 31–33 are produced only when magneto 11 is being rotated. A conductor 36 conveys a signal from ignition power circuit 22 to timing power circuit 27 to indicate that rotation is occurring, thus providing automatic battery connect/disconnect eliminating the need for an ignition on/off switch.

Figure 2:
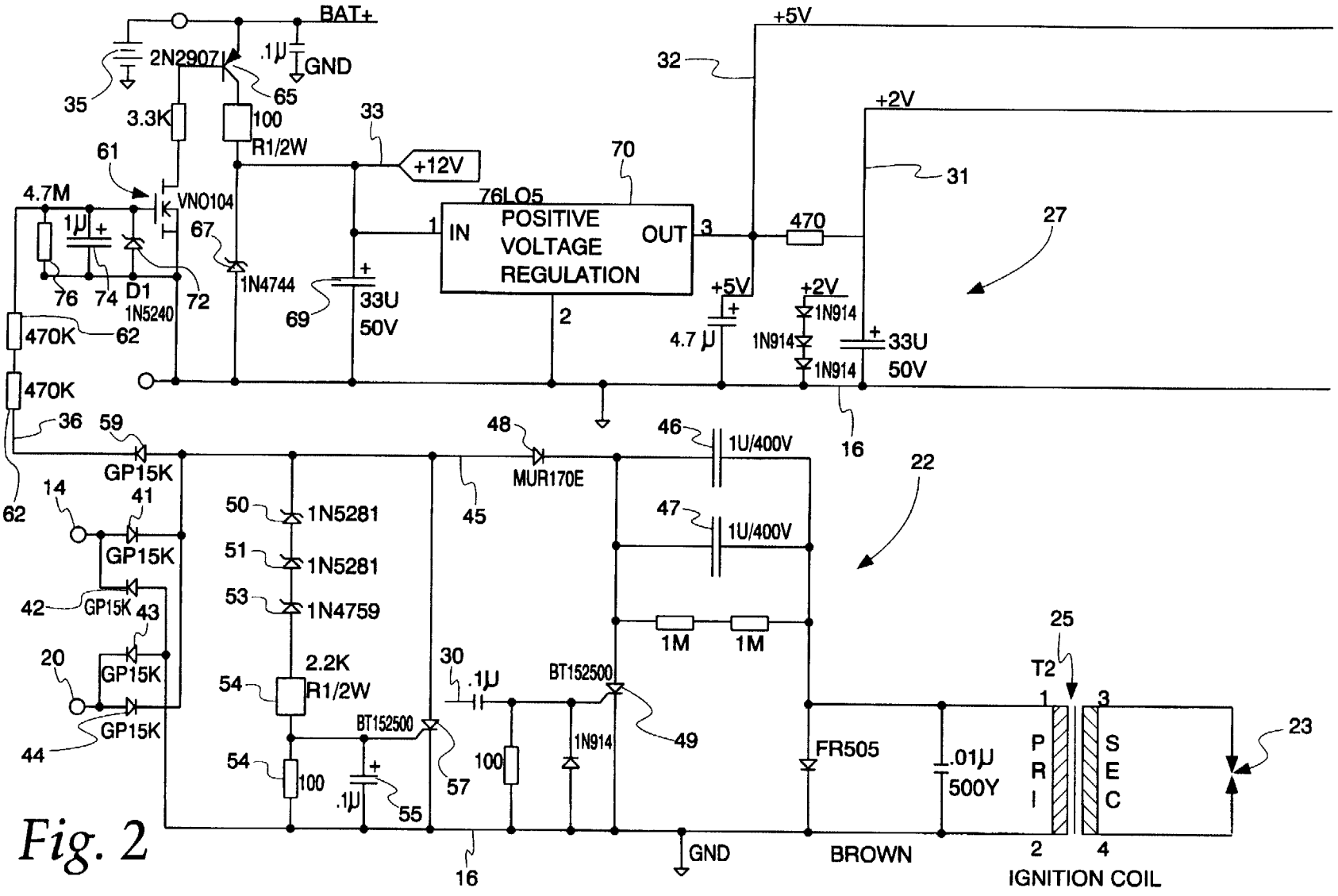
FIG. 2 is a schematic diagram showing the ignition power and timing power circuitry for the electronic ignition system of FIG. 1.

FIG. 2 shows the circuitry used to implement the ignition power circuit 22 and the timing power circuit 27. When the magneto 11 rotates the voltages on conductors 19 and 20, it is fullwave rectified by a bridge circuit comprising diodes 41–44 and applied between conductors 45 and 16 (ground). The resultant voltage on conductor 45 is connected to ignition storage capacitors 46 and 47 (1 microfarad each) via a diode 48. The energy stored by the two microfarad capacitance of capacitors 46 and 47 is periodically released in response to trigger pulses on conductor 30, each of which discharges the capacitors through the primary of coil 25 by the operation of an SCR 49. The ignition spark is received from the secondary of coil 25. A series of zener diodes 50, 51 and 52 in conjunction with resistors 53 and 54 and capacitor 55 generate a control voltage which is applied to the gate of an SCR 57. The control voltage regulates the conduction of SCR 57 to clamp the voltage on conductors 45 to approximately 480 V.

The magneto voltage being fullwave rectified provides much quicker charging of storage capacitors 46 and 47 than the Kawasaki 750 Jet Ski stock ignition which only half-wave rectifies the magneto voltage. With the maximum magneto and thus the maximum capacitor voltage regulated to about 480 volts, the energy from the 2 microfarad capacitance equates to:

$$J=\tfrac{1}{2}C(V*V)$$

$$J=2uF*(480\ V*480\ V)*0.5$$

$$J=230\ \text{millijoules}$$

This is 6 times the stock ignition energy of about 38 millijoules providing a much hotter spark with longer spark duration. The ignition also generates a much higher spark voltage (up to 50 kilovolts using the stock ignition coil compared to 18 kilovolts with the stock ignition) because of the higher capacitor voltage.

The voltage on conductor 45 is also applied via a diode 59 and conductor 36 to the timing power circuit 27. The presence of a voltage on conductor 36 identifies to the timing power circuit 27 that the magneto 11 is turning and that power should be applied to timing circuit 29 via conductors 31–33. The voltage on conductors 36 is applied to the gate of a MOSFET 61 via a pair of resistors 62. The application of gate voltage to MOSFET 61 causes it to conduct which by connection to the base of a transistor 65 applies the voltage from battery 35 to a 12 V regulator consisting of zener diode 67 to capacitor 69 and a 5 V integrated circuit regulator 70. The output of regulator 70 is the 5 V source 32 a portion of which is again regulated to produce the 2 V source in the manner well known in the art.

The input to the gate of MOSFET 61 is clamped at 10 V by a zener diode 72, a capacitor 74 and a resistor 76. This gate clamp circuitry protects MOSFET 61 and it advantageously maintains the power to timing circuit 29 for a period of time after the signal on conductor 36 indicates that the magneto 11 has stopped rotating. Such time delay turnoff is produced by capacitor 74 which must discharge through resistor 76 before the voltage at the gate of MOSFET 61 drops to cutoff. In the present embodiment, a delay of 20–30 seconds has been found advantageous. After the gate voltage reduces and MOSFET 61 turns off power is removed from the timing circuit thereby preserving the charge of battery 35.

Figure 3:
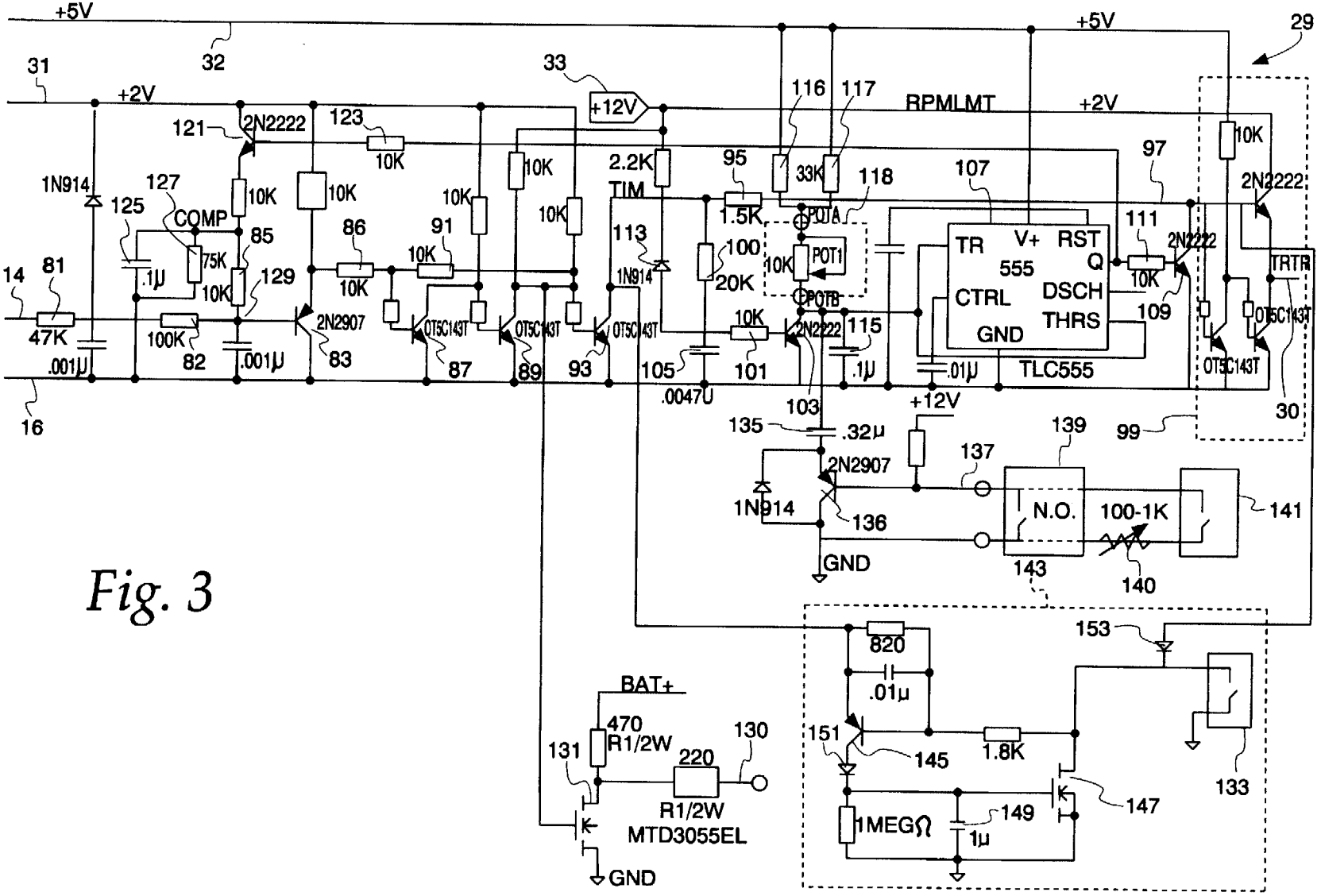
FIG. 3 is a schematic diagram showing timing circuitry used to respond to signals from a pickup to generate trigger signals for use in the electronic ignition system of FIG. 1.

FIG. 3 shows the timing circuitry used to respond to signals from pickup 13 on conductors 14 and 16 by generating appropriate trigger signals on conductor 30. As is described in detail below, the circuitry provides precise trigger pulses and includes a limit on engine rpm, a limit on engine rpm in the case of overheating, a kill switch feature, a tachometer output and a variable threshold for the sensing of pickup 13 voltages.

Signals from pickup 13 are applied via resistors 81 and 82 to the base of a PNP transistor 83 which will become conductive when its base is slightly negative. The base of transistor 83 is also connected to a terminal of a resistor 85 which connection is used to provide a variable threshold for the detection of a timing pulse from pickup 13 proportional to engine speed. The operations of the variable threshold is discussed later herein.

The collector of transistor 83 is connected via a resistor 86 to the base of an NPN transistor 87 having its collector directly connected to the base of a NPN transistor 89. The collector of transistor 89 is connected via a feedback resistor 91 and is directly connected to the base of an NPN transistor 93. The normal (non pulse) state of transistor 93 is the on state in which its collector is near 0 V. By the interconnection of transistors 83, 87, 89 and 93, when the input voltage of the base of transistor 83 becomes lower than its trigger threshold the collector of transistor 93 abruptly rises to near the 12 V supply. It should be mentioned that because of the high gain and the feedback of resistor 91, change in voltage of transistor 93 occurs rapidly and with great immunity to noise at the input to the timing circuit.

The collector voltage of transistor 93 is connected via a resistor 95 to a conductor 97 which in turn is connected as an input to a driver circuit 99 of conventional electronic design. When the signal on conductor 97 is near 0 V the output of driving circuit 99 on conductor 30 is at a low level and when the signal on conductor 97 increases the voltage level on output conductor 30 also increases. It will be remembered that the signal on conductor 30 is the trigger signal which controls SCR 49 of ignition power circuit 22 to generate a spark pulse (FIG. 2).

The collector of transistor 93 is also connected via series connected resistors 100 and 101 to the base of a transistor 103. The junction of resistors 100 and 101 is also connected to ground via a capacitor 105. By the operation of resistors 100 and 101 and capacitor 105 transistor 103 becomes conductive approximately 30 microseconds after the voltage at the collector of transistor 93 goes high. The collector of transistor 103 is connected to the TR input of a type 555 timer, integrated circuit timer 107. Any one-shot timer or multivibrator circuit may be used for the timer 107. When transistor 103 becomes conductive the TR input of timer 107 is driven low. This causes the Q output of timer to go high (5 V) which drives a transistor 109 to the on state via a resistor 111. When transistor 109 becomes conductive, the voltage on conductor 97 is held low.

The result of the above-described circuitry in the generation of trigger pulses by driving circuit 99 is as follows. When a pickup pulse is detected, the collector of transistor 93 goes high raising the voltage on conductor 97. Driver circuit 99 responds to the increased voltage on conductor 97 by beginning a trigger pulse on conductor 30. Approximately 30 microseconds after conductor 97 goes high, transistor 103 becomes conductive which drives transistor 109 conductive via the timer 107. When transistor 109 becomes conductive, conductor 97 is taken low thus terminating the trigger pulse on conductor 30 after 30 microseconds. Such a 30 microsecond pulse will be generated each time the collector of transistor 93 goes high.

Timer 107 is also used to control a maximum rpm amount for the engine. The collector transistor 93 will go from high to low when the input signal on conductor 14 indicates that the firing position is not near. When the collector of transistor 93 goes low, capacitor 105 discharges through a diode 113 and transistor 103 becomes non-conductive and a timing capacitor 115 will begin to charge via resistors 116, 117 and 118. When capacitor 115 is charged to ⅔ of the supply voltage at the TR input of timer 107, the timer will change state causing its output Q to be low. The output Q will remain low until the next timing signal is detected from conductor 14.

The output Q of timer 107 is connected to the base of transistor 109. When the output Q is high, the conductor 97 will be held low regardless of the signal at the collector of transistor 93. Thus holding transistor 109 in the conductive state will keep any additional trigger pulse from being generated. This feature is used to limit the rate at which trigger pulses can be generated.

Once a timing pulse is deleted and transistor 103 becomes conductive, the output Q of timer 107 goes high until the timer period defined by resistors 116, 117 and 118 and capacitor 115 causes timer 107 to time out, thus bringing output Q low again. Should a timing pulse be detected before timer 107 times out that pulse will be shunted to ground by transistor 109 before it can start another trigger pulse. In the present embodiment, the resistor 118 is a potentiometer making a wide range of minimum times between trigger pulses possible. In practice, above-described circuitry for limiting engine speed might provide an adjustable rpm limit (revlimit) having user settings typically from about 6300 rpm to about 9000 rpm.

As previously discussed, the present embodiment also includes circuitry for varying the input threshold for the detection of timing pulses based on the rotation rate of the engine being controlled. This function is desirable since at low rates the timing pulses from the pickup 13 will be relatively small and at high engine speeds the timing pulses are larger with more electrical noise impinging on the system.

The circuitry of FIG. 3 includes a transistor 121 which has its base connected to the Q output of timer 107. The output Q will produce a sequence of substantially fixed length pulses at a rate matching the timing pulses which indicate engine speed. Each pulse applied to the base of transistor 121 charges a capacitor 125 to a predetermined voltage. At the end of the pulse transistor 121 becomes non-conductive and capacitor 125 begins to discharge through a resistor 127.

The voltage of capacitor 125 is summed with incoming timing pulses at a node 129. At slow engine speeds, capacitor 125 will be completely discharged before a next timing pulse occurs and a small, e.g., 0.5 V, negating going timing pulse will cause transistor 83 to become conductive. As the engine speed increases, less time is available to discharge capacitor 125 and some residual voltage will remain on capacitor 125 when the next input timing pulse is received. This residual voltage is summed with the incoming pulse at node 129 and accordingly, the timing pulse must overcome the residual voltage before transistor 83 will become conductive. In the present embodiment, timing pulses 10 V or greater negative are required for near maximum engine speed. This compensated magnetic-pickup input circuit provides high noise immunity.

The present embodiment also includes additional advantageous features. A tachometer output 130 provides an impedance protected output by connecting the gate of a MOSFET 131 to the collector of transistor 89. A latching kill switch also is provided at 133. Trigger pulses are terminated hence stopping the engine by providing a low impedance path to ground, e.g., less than 2300 ohms to ground.

The kill switch circuit 143 provides a means to latch the ignition trigger pulses off until no further pulses are detected at the trigger input section. When the kill switch 133 closes momentarily, transistor 145 is biased on while its emitter is pulled up from the timing signal at the collector of transistor 93, thus charging capacitor 149 via diode 151 providing a bias potential at MOSFET 147. As MOSFET 147 turns on, its drain pulls the connection from kill switch 133 to ground, keeping transistor 145 biased on and clamping the trigger pulse signal on conductor 97 via diode 153. While the engine is spinning, no further trigger pulses are generated and the kill circuit stays latched until the engine stops spinning. The above-described latching kill switch circuit resets when no input trigger pulses are detected and after capacitor 149 is discharged, reducing the gate bias voltage on MOSFET 147. Reset occurs approximately 1–2 seconds after the engine stops spinning.

Also, an arrangement for reducing maximum rpm when the engine overheats is provided. The overheat circuitry includes a normally-open temperature sensor 139 which provides a low impedance path between the base of a transistor 136 and ground when overheating is sensed. Grounding the base of transistor 136 causes it to become conductive which effectively adds the value of a capacitor 135 to the timing capacitor. Thus, an increased capacitance must now be charged for timer 107 time out which lengthens the minimum permitted time between trigger pulses, reducing the maximum allowable rpm amount for the engine as determined by timer 107, as discussed above. In practice, the timing capacitance is effectively increased to enable the engine to operate at about one-third the maximum user set revlimit or about 3000 rpm.

The normally open switching design of the above-described overheat circuitry allows the over-temperature input at temperature sensor 139 to be used both as an engine speed revlimiter by the temperature sensor 139 and as input for a user controlled "holeshot" switch 141. This holeshot feature allows the use of a handlebar mounted switch to be wired across the over-temperature sensor 139, allowing the user to purposely lower the engine speed by closing the holeshot switch 141 at the start of a race while holding the throttle at its full speed position. This allows instant acceleration once the holeshot switch is released and revlimit changes to the maximum engine speed.

The overtemp revlimit speed can also be adjusted for the holeshot switch by adding a resistor 140 of between 100–1 k ohms in series with the holeshot switch 141. The higher the value of this resistor, the higher the engine rpm. This holeshot revlimit speed can then be set to the desired optimum speed to start the race. The holeshot revlimit can be adjusted from the minimum value of about 3000 rpm up to the maximum revlimit value of about 9000 rpm. These features are not available with stock ignitions.

The above illustrative embodiment describes an electronic ignition system for use with existing ignition circuitry in sport vehicles, but the principles taught herein may be adapted for use with any electronic ignition system. Each aspect of the system being exemplary, the scope of the invention is not intended to be limited to the specific embodiment shown and described. Instead, the scope of the invention is intended to encompass those modifications and variations which will be apparent to those skilled in the art, the scope being defined by the appended claims.

What is claimed is:

1. An ignition for use with an engine rotated magneto comprising:

means for converting a voltage output of the magneto to a DC voltage;

a timing circuit operative when enabled to generate trigger pulses;

means responsive to said converting means DC voltage for enabling the timing circuit;

means responsive to the trigger pulses for applying pulses of the DC voltage as ignition pulses to an ignition coil;

temperature sensing means for disabling said timing circuit according to the temperature of the engine; and a user operable holeshot switch connected across said temperature sensing disabling means for controlling the application of said trigger pulses to said ignition coil.

2. An ignition for use with an engine rotated magneto comprising:

means for converting a voltage output of the magneto to a DC voltage;

a timing circuit operative when enabled to generate trigger pulses;

means responsive to said converting means DC voltage for enabling the timing circuit;

means responsive to the trigger pulses for applying pulses of the DC voltage as ignition pulses to an ignition coil;

a battery connectable to the ignition; and means for connecting said battery responsive to said converting means connecting said battery to the ignition during the presence of the voltage output of the magneto and during a short amount of time thereafter.

3. An apparatus for generating a trigger pulse for controlling an electronic ignition system comprising:

detection circuitry responsive to signals from a timing pickup device for detecting a timing pulse therefrom and for generating a detection signal, said detection circuitry comprising threshold circuitry for establishing a detection threshold for the detection of timing pulses, and the apparatus comprising means responsive to the rate of timing pulses received from the pickup device for varying the detection threshold;

trigger pulse means responsive to said detection signal for beginning said trigger pulse;

delay means for generating a delayed detection signal following said detection signal by a first predetermined amount of time; and pulse ending circuitry responsive to said delayed detection signal in reference to said delayed detection signal and defining the beginning of a second predetermined amount of time for inhibiting the generation of said trigger pulse during said second predetermined amount of time begun after an amount of time substantially equal to said first predetermined amount of time;

means for detecting engine temperature wherein said second predetermined amount of time changes duration according to said engine temperature.

4. An apparatus in accordance with claim 3 wherein said second predetermined amount of time is determined by the output of an electronic timer circuit and said delayed detection signal triggers said timer circuit.

5. An apparatus in accordance with claim 4 wherein said timer circuit comprises a multivibrator and a capacitance associated therewith for driving said second predetermined amount of time.

6. An apparatus in accordance with claim 5 comprising a second capacitance associated with said multivibrator to increase said second amount of time according to said engine temperature detected by said detecting means.

7. An apparatus for generating a trigger pulse for controlling an electronic ignition system comprising:

detection circuitry responsive to signals from a timing pickup device for detecting a timing pulse therefrom and for generating a detection signal, said detection circuitry comprising threshold circuitry for establishing a detection threshold for the detection of timing pulses, and the apparatus comprising means responsive to the rate of timing pulses received from the pickup device for varying the detection threshold, wherein said circuitry for establishing a detection threshold increases said threshold for increasing engine speed;

a charged capacitor providing said threshold wherein said capacitor begins to discharge providing a varying threshold proportional to engine speed;

trigger pulse means responsive to said detection signal for beginning said trigger pulses;

delay means for generating a delayed detection signal following said detection signal by a first predetermined amount of time; and pulse ending circuitry responsive to said delayed detection signal in reference to said delayed detection signal and defining the beginning of a second predetermined amount of time for inhibiting the generation of said trigger pulse during said second predetermined amount of time begun after an amount of time substantially equal to said first predetermined amount of time, wherein said capacitor is charged during said second amount of time and begins to discharge thereafter.

8. An apparatus for generating a trigger pulse for controlling an electronic ignition system comprising:

detection circuitry responsive to signals from a timing device for detecting a timing pulse therefrom and for generating a detection signal;

trigger pulse means responsive to said detection signal for beginning said trigger pulse;

delay means for generating a delayed detection signal following said detection signal by a first predetermined amount of time;

pulse ending circuitry responsive to said delayed detection signal in reference to said delayed detection signal and defining the beginning of a second predetermined amount of time for inhibiting the generation of said trigger pulse during said second predetermined amount of time begun after an amount of time substantially equal to said first predetermined amount of time; and low impedance switching means coupled to said trigger pulse beginning means for inhibiting said beginning means preventing false triggering in a salt water environment.

9. An apparatus in accordance with claim 8 wherein said pulse ending means comprises a timer for generating an inhibit signal beginning said first predetermined period of time after said detection signal and ending after said second predetermined period of time.

10. An apparatus in accordance with claim 8 wherein said second predetermined amount of time is determined by the output of an electronic timer circuit, said delayed detection signal triggers said timer circuit, and said timer circuit comprises a multivibrator and a capacitance associated therewith for deriving said second predetermined amount of time.

11. An apparatus in accordance with claim 8 comprising latch means for latching said switching means in its low impedance state.

12. An apparatus in accordance with claim 8 wherein said latch means comprises an energy storage device connected to said detection circuitry and a switching device connected to said trigger pulse means, said energy storage device storing electrical energy from said detection signal and developing a potential for biasing said switching device in an on state.

13. An apparatus in accordance with claim 8 comprising means for coupling said timing pulse from said detection circuitry for use with a tachometer.

14. An internal combustion engine ignition method for use with an ignition coil and an engine rotated magneto, the method comprising the steps of:

converting a voltage output of the magneto to a DC voltage;

receiving a trigger signal;

applying said DC voltage to the ignition coil responsive to said receiving step;

delaying a first predetermined amount of time after said receiving step;

inhibiting said applying step from applying said Dc voltage to the ignition coil for a second predetermined amount of time; and determining the temperature of the engine, said temperature determining said second predetermined amount of time at said inhibiting step.

15. A method in accordance with claim 14 wherein said trigger signal receiving step has a variable threshold associated therewith and comprises the step of increasing said threshold with the speed of engine rotation providing noise immunity at high speeds.

* * * * *

UNITED STATES PATENT AND TRADEMARK OFFICE

CERTIFICATE OF CORRECTION

PATENT NO. : 5,526,785

DATED : June 18, 1996

INVENTOR(S) : Stephen C. Masters

It is certified that error appears in the above-indentified patent and that said Letters Patent is hereby corrected as shown below:

Column 9, line 6, after "timing" insert --pickup--.

Signed and Sealed this

Tenth Day of December, 1996

*Attest:*

*Attesting Officer*

BRUCE LEHMAN

*Commissioner of Patents and Trademarks*